US008699303B2

(12) United States Patent
Caruso

(10) Patent No.: US 8,699,303 B2
(45) Date of Patent: Apr. 15, 2014

(54) UNIVERSAL TIMEPIECE DIAL, ANALOGICAL TIMEPIECE AND DIGITAL TIMEPIECE COMPRISING THE DIAL

(75) Inventor: Francesco Caruso, Palermo (IT)

(73) Assignee: Voyager Watches di Francesco Caruso (CH)

( * ) Notice: Subject to any disclaimer, the term of this patent is extended or adjusted under 35 U.S.C. 154(b) by 145 days.

(21) Appl. No.: 13/515,441

(22) PCT Filed: Dec. 27, 2010

(86) PCT No.: PCT/IB2010/056078

§ 371 (c)(1),
(2), (4) Date: Jun. 12, 2012

(87) PCT Pub. No.: WO2011/080690

PCT Pub. Date: Jul. 7, 2011

(65) Prior Publication Data

US 2013/0003504 A1 Jan. 3, 2013

(30) Foreign Application Priority Data

Dec. 30, 2009 (IT) ..... VI20090061 U
Mar. 22, 2010 (IT) ..... V120100013 U

(51) Int. Cl.
*G04B 19/22* (2006.01)

(52) U.S. Cl.
USPC ..... 368/27; 368/76; 368/233

(58) Field of Classification Search
USPC ..... 368/21–22, 27, 76–77, 233
See application file for complete search history.

(56) References Cited

U.S. PATENT DOCUMENTS 372,642 A * 11/1887 Staubitz ..... 368/27
1,034,496 A * 8/1912 Olinger ..... 368/27
1,676,000 A * 7/1928 Whitman ..... 368/27
2,312,236 A * 2/1943 Conlon ..... 368/27
2,723,527 A * 11/1955 Smith ..... 368/233
4,222,227 A * 9/1980 Arabian ..... 368/27
4,319,350 A * 3/1982 Fatton ..... 368/22
4,847,819 A * 7/1989 Hong ..... 368/21
4,945,521 A 7/1990 Klaus

FOREIGN PATENT DOCUMENTS

CH 207747 A 11/1939
CH 215450 A 6/1941
EP 0769733 A1 4/1997
FR 2911193 A1 7/2008
WO WO 2005/043258 A1 5/2005

* cited by examiner

*Primary Examiner* — Sean Kayes
(74) *Attorney, Agent, or Firm* — R. Neil Sudol; Henry D. Coleman

(57) ABSTRACT

A world timepiece dial comprising a first ring (2) for minutes, with a first series of digits marked thereon, a second ring (4) for hours, with a second series of digits marked thereon, a third ring (6) with a plurality of time-zone indicating geographical site markings, such markings being adapted to be angularly aligned with the numbers of the first and second series, for instant and simultaneous reading of the time in the geographical sites. The second ring (4) is divided into twelve angular sectors (8, 8', 8", . . . ) each bearing one digit of the second series marked thereon. The markings of the third ring (6) are arranged over at least two concentric circular areas (9, 10), each marking of one of the areas (9) being radially opposed to one marking of at least another area (10) to define respective pairs (11, 11', 11", . . . ). The geographical sites of each pair (11, 11', 11", . . . ) are selected for the time offset between their respective time zones to be twelve hours. An analog timepiece and a digital timepiece comprising the dial.

15 Claims, 4 Drawing Sheets

UNIVERSAL TIMEPIECE DIAL, ANALOGICAL TIMEPIECE AND DIGITAL TIMEPIECE COMPRISING THE DIAL

FIELD OF THE INVENTION

The present invention generally finds application in the field of timepieces and particularly relates to a world timepiece dial designed to allow simultaneous reading of the time in a plurality of time zones.

The invention also relates to an analog timepiece and a digital timepiece comprising such world dial.

BACKGROUND ART

Various models of world timepieces, particularly of analog type, are known in the art, i.e. timepieces that have a dial and an hour marking mechanism designed to allow simultaneous reading of the time in two or more different time zones of the globe.

One common and simple type of timepieces adds to the normal hour and minute rings, typical of classical analog watches, an additional outer ring, with the names of the places representative of each of the time zones into which the globe is typically divided marked thereon. The name of the place may be combined with an indication of the time offset from the time zone of the user.

Nevertheless, in these solutions the user is forced to calculate the time for each desired time zone from the time indicated by the hands, and while this calculation is simple, it still causes reading of the various time zones non immediate and susceptible to errors.

In other types of timepieces the rings and the hands move relative to each other in a direction opposite to classical dials, with the former being rotatably movable and the latter fixed at a predetermined position, susceptible of being changed by the user.

In certain cases, the hands may be simply replaced by a single fixed reference marked on the dial.

For instance, EP1181625 discloses an analog world timepiece dial, having a central movable disk with the minute division, a first inner ring, also movable, divided into 24 hour sectors, and a fixed index external to both the central minute disk and the hour ring.

The current time is given by the markings of the hours and minutes read from time to time at the fixed index.

The dial also has a second ring, immediately external to the first hour ring, with the names of one or more places for each time zone marked thereon.

Thus, time may be instantly determined for each time zone, by reading the reference numbers of the first ring and the disk, that are aligned with the name of the place representative of the time zone.

While this solution allows substantially simultaneous determination of the time for each time zone, it still has the apparent drawback of having an hour ring divided into 24 sectors, one for each time zone.

Therefore, the dial carries a large amount of information, which causes visual confusion and requires the use of very small characters, both for city names and for reference numbers, thereby preventing easy time reading.

EP0769733 discloses an universal timepiece having a dial with an hour hand a minute hand and an outer city ring with two concentric stripes of markings that indicate location of respective time zones. The markings of the two stripes are arranged to define pair of locations having a respective 12 hours offset local times.

However, the city ring rotates simultaneously with the hour dial, so that the time reading position on the dial changes and the user could not immediately read the time of his proper time zone.

DISCLOSURE OF THE INVENTION

The object of the present invention is to obviate the above drawbacks, by providing a world dial for analog or digital timepieces that is highly efficient and relatively cost-effective.

A particular object is to provide a world timepiece dial that allows simultaneous reading of two or more time zones other than that of the timepiece user.

A further object is to provide a world timepiece dial that allows clear instant reading of the time for a plurality of time zones.

Another object is to provide an analog or digital timepiece that allows simple instant reading of the time for a plurality of time zones at a time.

Yet another object is to provide an analog or digital timepiece that allows to convert the reference time to the particular time zone in which the user is, in a manual and/or automatic manner.

These and other objects, as better explained below, are fulfilled by a world timepiece dial as defined in claim 1, which comprises a first minute ring having a first series of digits on its exposed face, showing minutes, a second hour ring external to said first ring and having a second series of digits on its exposed face, showing hours, wherein the first and second rings rotate about their respective axes of rotation, a third ring coaxial and offset to said first and second rings, said third ring having a plurality of angularly offset geographical site markings thereon, indicative of predetermined time zones, said markings being adapted to be radially aligned to the digits of said first and second series for instant and simultaneous reading of the time in said geographical sites.

While reference is made herein to rings, it shall be understood that one or more of them may be replaced by disks, without departure from the scope of the present invention.

The rings or disks have a preferably circular or elliptical shape, although this shall be intended without limitation to the scope of the present invention.

The dial is characterized in that the second ring is divided into twelve angular sectors, each with a digit of said second series thereon.

Furthermore, the markings of the third ring are arranged over at least two concentric and radially offset circular areas, each marking of one of said areas being radially opposed to one marking of at least another of said areas to define respective pairs, the geographical sites of each of said pairs being selected for the time offset between their respective time zones to be twelve hours.

This combination of features allows simultaneous reading on the dial of the times at all the time zones that typically form the globe, through a relatively small number of digits and geographical markings.

As a result, the time will be read in a particularly clear and simple manner, as adequately large characters may be used, even on dials of relatively small size.

In a further aspect, the invention provides an analog timepiece comprising a dial as described herein.

Advantageously, the timepiece may comprise a movement with automatic means for automatic rotation of the third ring.

Preferably, the automatic means may include a radio signal receiver, particularly for receiving a GPS signal or the like, to receive information about the geographical position of the timepiece and transduce it into angular rotation of said third ring.

Due to this additional feature, the timepiece of the invention allows the user to always know in which time piece he/she is in at a given time, and is particularly useful during air or marine navigation.

In a further aspect, the invention relates to a digital timepiece comprising a dial as defined in claim 15.

BRIEF DESCRIPTION OF THE DRAWINGS

Further features and advantages of the invention will become more apparent from the detailed description of a few preferred, non exclusive embodiments of a hose world dial for analog or digital timepieces according to the invention, which are described as non limiting examples with the help with the accompanying drawings in which.

DETAILED DESCRIPTION OF A PREFERRED EMBODIMENT

Figure 1:
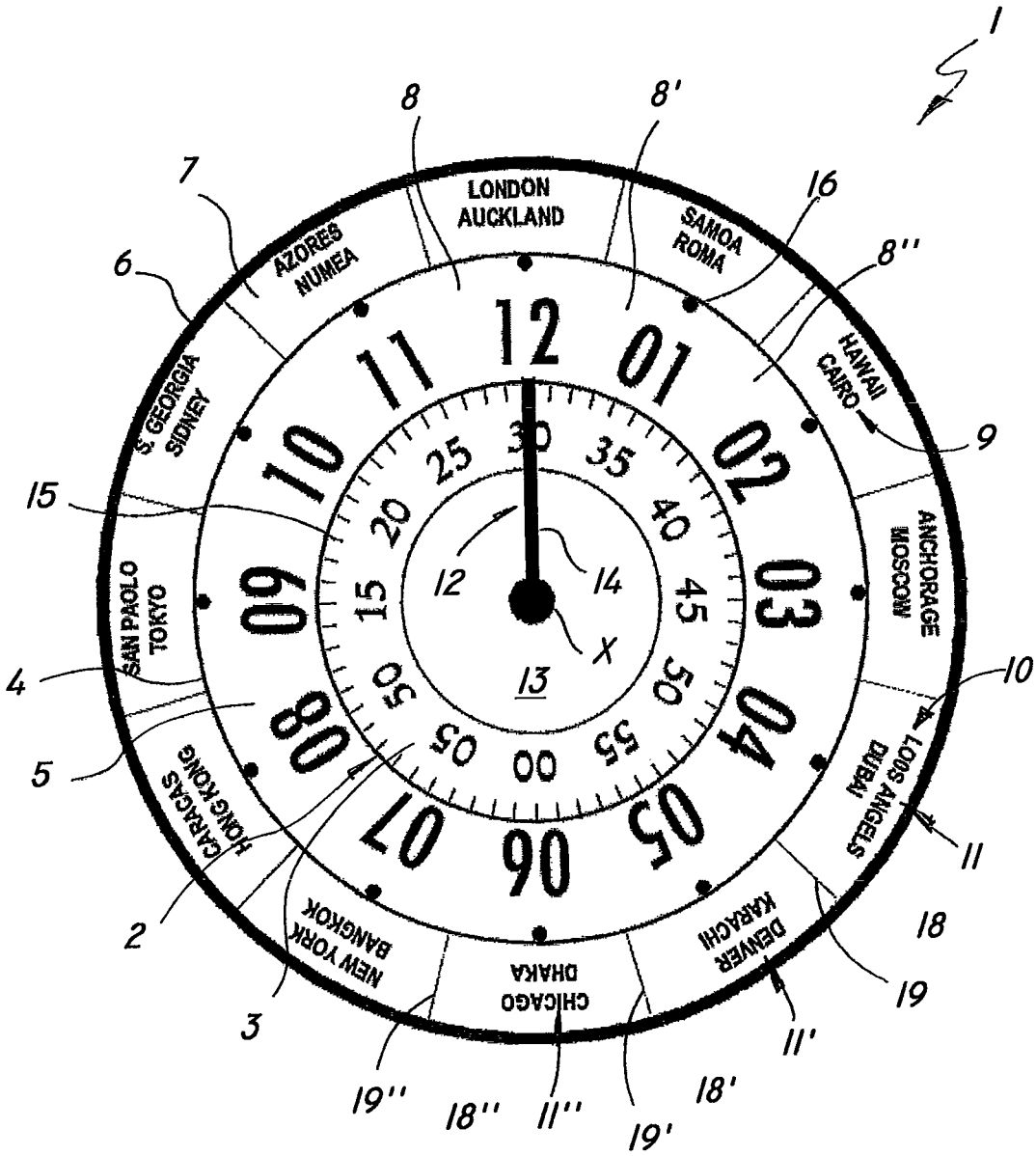
FIGS. 1 to 4 are front views of corresponding preferred, non limiting embodiments of a world dial of the invention.

Referring to the above figures, a world dial of the invention, generally designated by numeral 1, may be used with a common analog or digital timepiece, not shown in the figures.

In analog timepiece applications, the timepiece may have, as is known per se, a case housing therein any kind of movement, such as a mechanical movement, a quartz movement or electronic control of movements. Particularly, the movement will have at least one first and one second drive shafts.

A dial of the invention, used with an analog timepiece, and an analog timepiece comprising such dial, have been already disclosed in Italian application VI2009U000061 by the same Applicant.

The dial 1 of the invention may be associated with the movement, above the case and possibly protected by a clear screen, also not shown.

According to the invention, the world dial 1 comprises a first minute ring 2 which is capable of rotating and of being associated with a first shaft of the movement to be rotated thereby.

The first ring 2 has a first series of digits thereon, showing minutes.

A second hour ring 4 is also provided, which may be associated with a second shaft of the movement, to be also rotated thereby.

The second ring 4 is preferably but not necessarily coaxial with the first ring 2 and located external thereto, preferably without overlapping portions, and also has a second series of digits on its exposed face 5, showing the hours.

Preferably, but without limitation, both the first ring 2 and the second ring 4 are associated with respective shafts of the timepiece movement to rotate counterclockwise with a discrete motion.

The dial 1 further comprises a third ring 6 coaxial and offset to the first ring 2 and the second ring 4.

The third ring 8 may be internal or external to the first two rings 2, 4 or be interposed therebetween, preferably with no portion overlapping the first two rings 2, 4.

The third ring 6 has a plurality of angularly offset time zone-indicating geographical site markings on its exposed face 7.

The geographical sites may be places, regions, sites of historical or cultural interest or any other geographical designation, representative of a particular time zone of the globe.

The digits of the two rings 2, 4 may be shown as any printing type, not necessarily Arabic characters.

For example, old Roman numbers, Chinese ideograms or any other kind of character may be used to indicate numbers.

The markings of the third ring 6 may be also written in any alphabet, and with any printing type.

The markings will be also adapted to be angularly aligned with the digits of the first 2 and second 2 series, for instant and simultaneous reading of the time in any geographical site of the third ring 6.

In a first peculiar aspect of the present invention, the second ring 4 is divided into twelve angular sectors 8, 8', 8", . . . , not all being shown in the figures for clarity, each bearing one digit of the second series marked thereon.

Each of the angular sectors 8, 8', 8" may also bear a pair of 12-hour offset digits.

Furthermore, the markings on the third ring 6 are arranged over at least two concentric and radially offset circular areas 9, 10.

Particularly, each marking of one of the areas 9 is radially aligned and opposed to one marking of at least another area 10 to define respective pairs 11, 11', 11", . . . , which are also not all shown herein with their respective numerals.

Advantageously, the geographical sites of each of such pairs 11, 11', 11", . . . are selected for the time offset between their respective time zones to be twelve hours.

Thus, the time for a given time zone will be determined by the combination of the digit of the second series aligned with marking of the third ring 6 representative of the time zone whose time is desired, and the digit of the first series at a predetermined position, which is the same for all time zones.

Furthermore, each pair of radially aligned markings 11, 11', 11" will provide the time of two 12-hour offset time zones.

Thus, for each pair 11, 11', 11", . . . an antemeridian time will be read at one of the geographical sites and the corresponding postmeridian time will be read at the other geographical site of the same pair 11, 11', 11", . . . .

Advantageously, on each of the areas 9, 10 of the third ring 6, the geographical sites will be selected in such a manner that they have one-hour offset time zones.

The third ring 6 may be associated with the dial 1 in a removable manner, for possible replacement thereof with another third ring, with markings of different geographical sites, or with different positions of the sites, to account for standard time and daylight time, when applicable.

In a preferred, non-limiting embodiment of the dial 1, the latter may also include one or more indices associated with at least one of the rings 2, 4, 6, and adapted to be aligned with the digits and markings thereon to define an hour-and-minute time reading position at a given time zone and/or geographical site.

In one embodiment, not shown, the index may be defined by any mark located on one of the rings 2, 4, 6 or internal or external thereto, in a fixed portion of the dial 1.

Thus, the mark or index will define a fixed reading position 12, that may correspond to a user-selected reference time zone.

In the preferred embodiment of the figures, the dial 1 comprises a fixed central disk 13 internal to the first ring 2 and associated with an index 14.

However, the central disk 13 may be movable and possibly integral or formed of one piece with the first ring 2.

Also, in a further configuration, not shown, the central disk 13 may include an electronic display associated with processor means, not shown, which are designed to display additional indications concerning geographical sites belonging to the same time zone as the one marked on the third ring 6.

The processor means may be also designed to control the motion of the shafts and may also include a storage portion adapted to receive user and timepiece data.

The central disk 13 will further define a central axis X of rotation for the first 2 and second 4 rings.

In this case, the index 14 may have the form of a hand, that may extend to any length, to cover one or more of the rings 2, 4, 6 or not.

Also in this case, the hand 14 may be fixed in a predetermined angular position 12.

In one alternative embodiment of the invention, the hand 14 or similar index may be pivoted on the common axis of rotation X to change the predetermined angular time-reading position 12.

Particularly, the hand 14 may be susceptible to be rotated, either manually or by a drive device, not shown, of the timepiece 1 that will be equipped with the dial 1. The device may be manually operated, e.g. through a crown, or have an automatic operation.

This will allow displacement of the hand 14, and hence the angular time-reading position 12, to any one of the time zone markings.

This configuration will be particularly useful to move the angular reading position 12 to the particular time zone in which the timepiece is, or to any local time whatever.

While the figures show a single hand 14, additional hands may be mounted to the dial 1, to define corresponding angular reading positions 12.

Furthermore, although not shown, there may be a first minute-pointing hand on the first ring 2, and a second hour-pointing hand on the second ring 4, and possibly a third movable second-pointing hand.

These additional hands may be either fixed or movable by means of a manual or automatic drive.

The third ring 6 may be located on the dial 1 external to the first ring 2 and the second ring 4 and may be either movable or rotatably mounted, to be rotated about the center axis X.

In the latter case, the user will be allowed to change the angular position of the third ring 6 relative to the fixed central disk 13 and/or the other two rings 2, 4.

The third ring 6 may be also associated with a further drive shaft of the timepiece movement, to be automatically or manually rotated about the common axis X.

Figure 2:
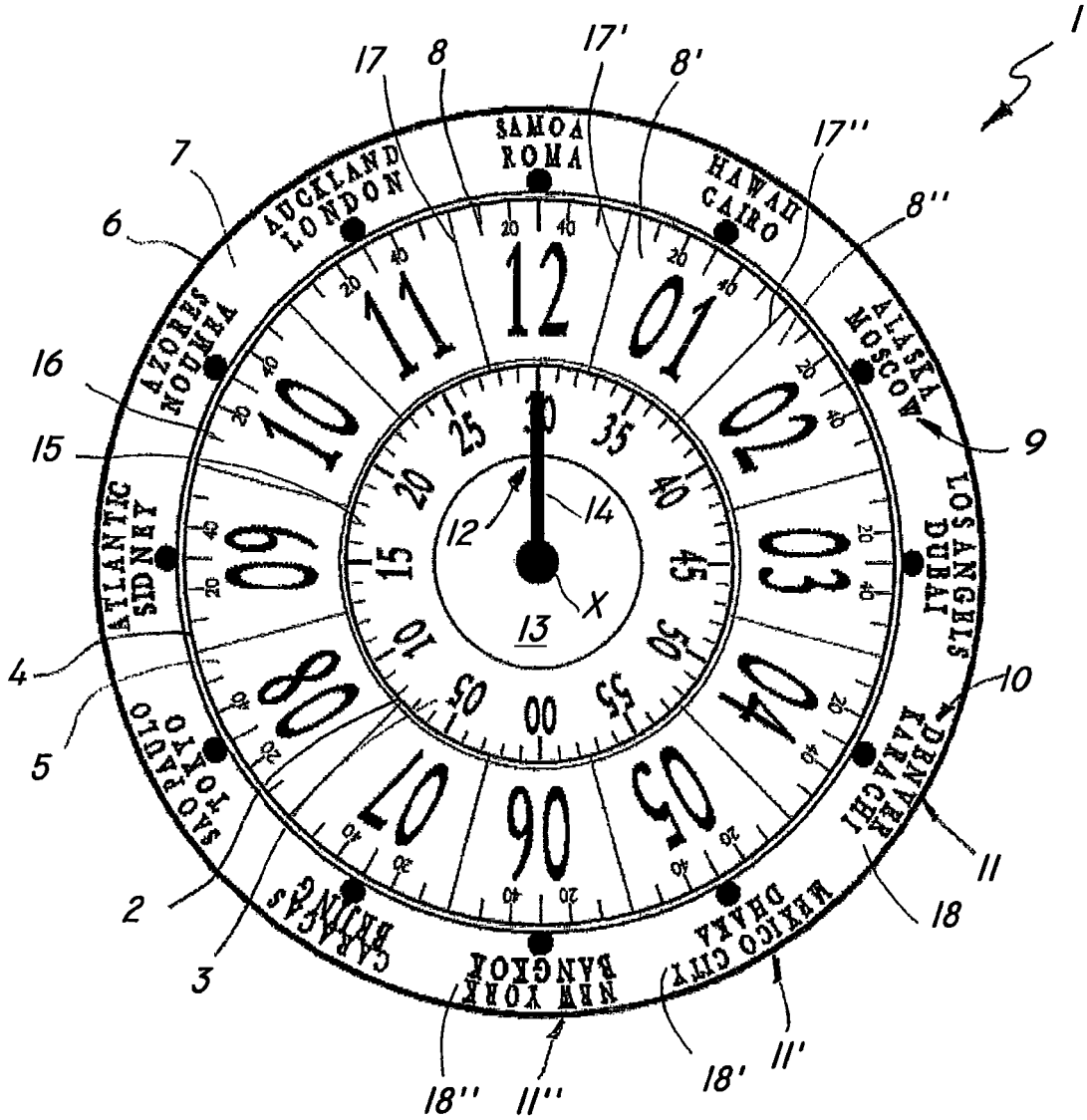
Figure 4:
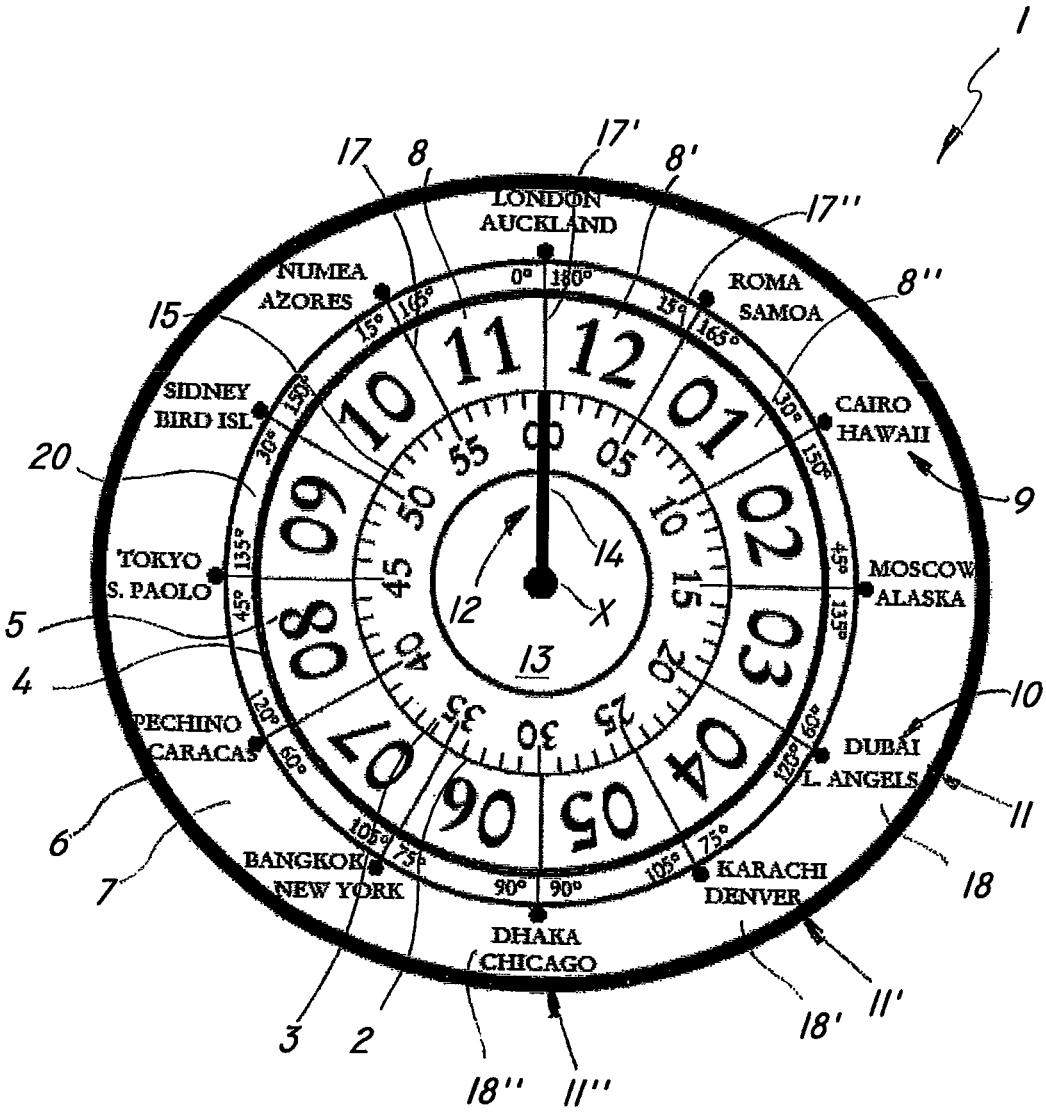

In a first embodiment of the dial 1, as shown in FIGS. 1, 2 and 4, both the digits of the first series and those of the second series are arranged on their respective rings 2, 4 in clockwise increasing order.

Particularly, the digits of the second series are provided in increasing order from 1 to 12.

In this first case, the first ring 2 and the second ring 4 are designed to rotate counterclockwise.

Figure 3:
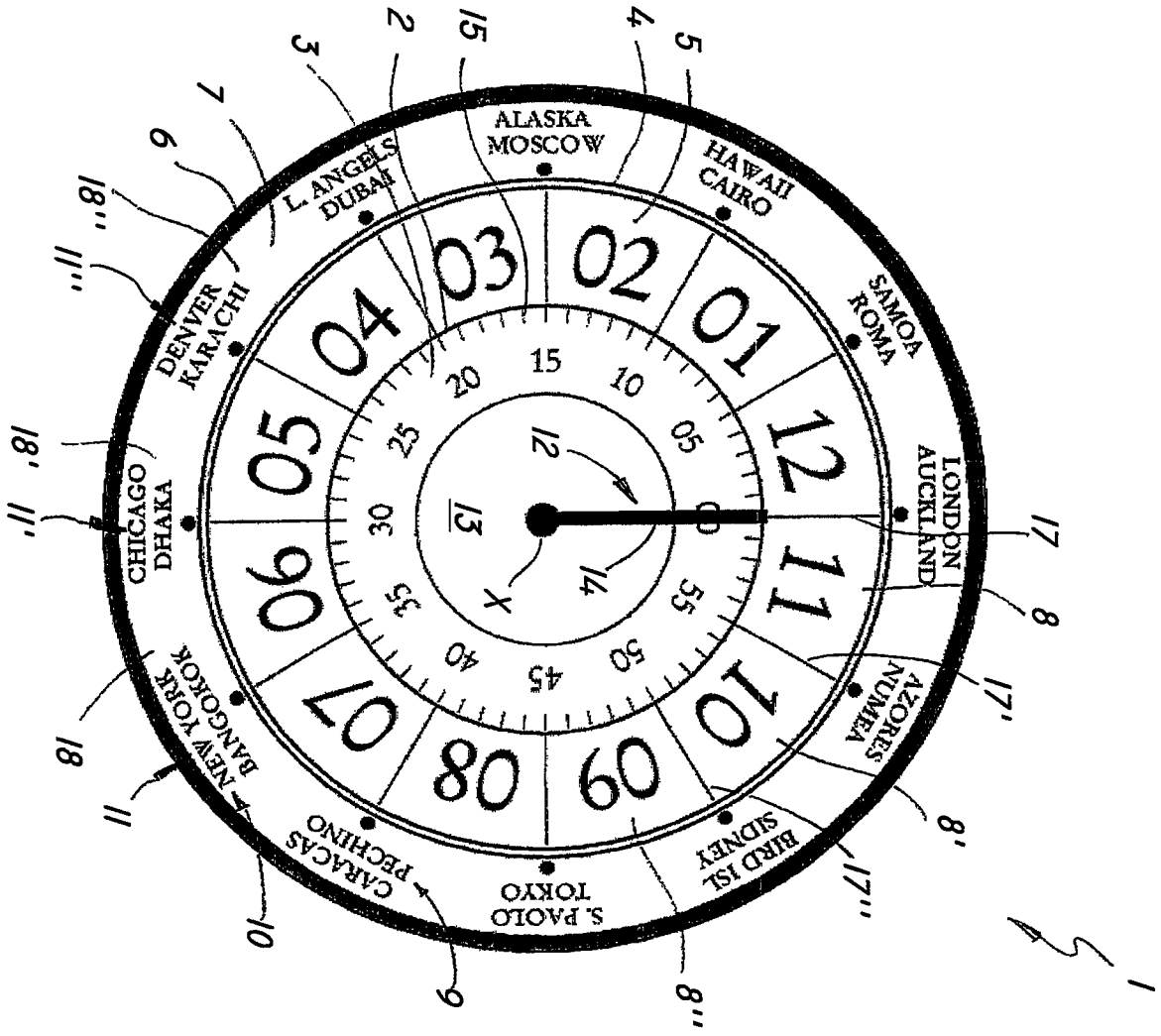

Conversely, in the configuration of FIG. 3, both the digits of the first series and those of the second series are arranged on their respective rings 2, 4 in counterclockwise increasing order. In this case, the first ring 2 and the second ring 4 are designed to rotate clockwise.

In an alternative embodiment of the dial 1, not shown, the digits of the first series may be in clockwise increasing order, and those of the second series may be in counterclockwise increasing order from 1 to 12, or vice versa.

Once again, in these additional configurations, the ring 2, 4 with clockwise increasing digits will be designed to rotate counterclockwise, and the ring 4, 2 with counterclockwise increasing digits will be designed to rotate clockwise.

The first ring 2 may have a variable number of digits, as is typically used in timepiece dials for minute indication.

Furthermore, the first 2 ring and/or the second ring 4 may have respective pluralities of subdivided portions, generally referenced 15 and 16 respectively, whose extension is smaller than or equal to the maximum radial dimension of their respective rings 2, 4.

These portions have the purpose of dividing their respective rings 2, 4 into a plurality of sectors defining predetermined time intervals, that may change from dial to dial.

In a further aspect, the contiguous angular sectors 8, 8', 8", . . . of the second ring 6 may be delimited and separated by respective substantially radial dividing lines 17, 17', 17", . . . , as shown in FIGS. 2 to 4.

Likewise, the third ring 6 may be also divided into twelve angular sectors 18, 18', 18", . . . each containing one pair of markings 11, 11', 11", . . . .

The angular sectors of the third ring 6 may be also separated by radial dividing lines 19, 19', 19", . . . , as shown in FIG. 1.

Furthermore, the dial 1 may comprise a fourth ring 20 coaxial with the first three rings and external or internal thereto, or interposed between two of them.

One example of this particular configuration is shown in FIG. 4, in which the fourth ring 20 is interposed between the second ring 4 and the third ring 6 and is preferably integral with the latter.

Advantageously, the fourth ring 20 bears a plurality of alphanumeric markings thereon, with auxiliary information for the user.

Such markings may be associated with respective pairs 11, 11', 11", . . . of geographical site markings.

For example, the alphanumeric markings may include longitude, expressed in degrees, and similar information allowing unique association thereof with a given time zone.

Auxiliary information may be generally selected from the group comprising latitude, longitude or similar indications for each time zone.

An analog timepiece including a world dial 1 as described hereinbefore may comprise a case, which is closed at its top by the dial 1 and contains a timepiece movement.

All timepiece components as described below are not shown, as they are known per se.

The movement has a plurality of drive shafts, e.g. integrally associated with corresponding gears, a first shaft being associated with the first ring 2 and a second shaft being associated with the second ring 4.

The two drive shafts may also be coincident and possibly associated with the common axis of rotation X of the first 2 and second 4 rings.

The movement also comprises means for automatic rotation of the first 2 and second 4 rings, whose design may be any one of the known designs for this kind of timepieces.

The timepiece movement may be any common movement and, as a non-limiting example, may be designed to cause continuous motion of the first minute ring 2 and discrete motion of the second hour ring 4.

The movement may also comprise further means for manual rotation of the third ring 6.

In combination with or instead of the latter configuration, the movement may comprise automatic means for automatic rotation of the third ring 6.

In a particular embodiment of the invention, the means for automatic rotation of the third ring 6 and/or the first two rings 2, 4 may comprise a radio signal receiver, which is adapted to automatically receive information about the geographical location of the timepiece, and particularly the time zone in which the user is.

The receiver may be also designed to transduce input information into angular rotation of the third ring 6 and/or the first two rings 2, 4.

For instance, the receiver may comprise an electronic control unit, which is appropriately programmed for processing the radio signal and generating a control to drive one or more drive shafts of the timepiece movement.

Particularly, the electronic control unit may be programmed to perform triangulation of any radio signal to determine the timepiece location. The radio signal may be a GPS, GSM, UMTS or the like signal.

In this case, the radio signal is processed in the electronic unit by appropriate software that recognizes the timepiece location data, and emits an analog electric signal to control the drive shaft/s of one or more rings 2, 4, 6.

The drive shaft may be the output shaft of a stepper motor, that will rotate the third ring 6 through an appropriate angle. The first ring 2 and the second ring 4 may be also rotated at the same time, in an integral or separate manner.

This, during air or marine navigation across multiple time zones of the globe, the third ring 6 may be rotated about the center axis X to align the time zone marking to the index 14, thereby allowing the user to know in which time zone he/she is at a given time.

In a second embodiment, the dial 1 of the invention may be designed to be mounted to a digital timepiece.

In this case, the dial comprises an electronic display and the digital timepiece may be equipped with a programmable logic unit, in which a computer program may be installed.

The latter may be appropriately designed to reproduce the image of the three rings 2, 4, 6 on the display, as well as their respective digits and markings to show the time and time zones as described above.

Furthermore, the program will be designed to emulate the motion of the rings 2, 4, 6, as described above, thereby emulating the operation of an analog timepiece on the display.

The electronic display and the program may be also designed to represent the index or hand 14 and/or the fourth ring 20 and/or any other component as described above.

In one particular embodiment, the digital timepiece may be integrated in a cell phone, in an electronic programmer, such as a PC, or in any other electronic device having other purposes, in addition to the timepiece purpose.

Furthermore, the digital timepiece may also comprise automatic means for automatic rotation of the third ring 6, which have the same operation as described above concerning the analog timepiece.

The dial and timepiece of the invention are susceptible to a number of changes or variants, within the inventive concept disclosed in the appended claims. All the details thereof may be replaced by other technically equivalent parts, and the materials may vary depending on different needs, without departure from the scope of the invention.

While the dial and timepiece have been described with particular reference to the accompanying figures, the numerals referred to in the disclosure and claims are only used for the sake of a better intelligibility of the invention and shall not be intended to limit the claimed scope in any manner.

The invention claimed is:

1. A world dial, comprising:

an inner circular dial showing minutes and hours;

an outer ring coaxial and radially offset to said inner circular dial having a plurality of angularly offset geographical site markings thereon, indicative of predetermined time zones, wherein said geographical site markings are arranged over at least two concentric and radially offset circular stripes, each marking of one of said stripes being radially opposed to one marking of at least another of said stripes to define respective pairs of geographical sites, said sites of each of said pairs being selected for the time offset between their respective time zones to be twelve hours;

wherein said inner circular dial comprises a first ring adapted to rotate about an axis of rotation and having a first series of digits on its exposed face showing minutes, and a second ring external to said first ring and adapted to rotate about said rotation axis, said second ring having a second series of digits on its exposed face showing hours, said second ring being divided into twelve angular sectors each bearing one digit of said hour series thereon, said outer ring defining a third ring external to said second ring, said third ring being stationary and independent from said first and second ring, said markings of said third ring being designed to be angularly aligned to the digits of said first and second series of digits for instant and simultaneous reading of the time in said geographical sites.

2. A dial as defined in claim 1, wherein the angularly adjacent geographical sites marked on each of said stripes are selected so that they have one-hour offset time zones.

3. A dial as defined in claim 1, further comprising at least one index associated with at least one of the rings, and adapted to be aligned with the digits and markings thereon to determine the hour-and-minute time at a given location taken from the group consisting of time zone and geographical site.

4. A dial as defined in claim 3, wherein the dial is mountable to a digital timepiece having a programmable logic unit, further comprising a display for digitally displaying the rings, said display being designed to reproduce an image of said rings with respective digits and markings thereof and of said index and to emulate the motion of said rings for emulating on said display the operation of an analog timepiece.

5. A digital timepiece comprising a dial as defined in claim 4, and a programmable logic unit in which a computer program may be installed, for reproducing said first ring, said second ring and said third ring on said display and emulating respective rotations about a common axis.

6. A timepiece as defined in claim 5, wherein said dial is integrated in an electronic device and comprises automatic means for automatic rotation of one or more of the rings.

7. A dial as defined in claim 3, further comprising a fixed central disk internal to said first ring and associated with said at least one index, said central disk defining said central axis of rotation for said first ring and said second ring, said at least one index being fixed in a predetermined angular position or pivoted on said common axis to modify said predetermined angular position.

8. A dial as defined in claim 1, wherein the digits of said first series are in increasing order from 1 to 12 in one clock or angular direction, the digits of said second series being in increasing order from 1 to 12 in the same clock or angular direction.

9. A dial as defined in claim 1, wherein the digits of said first series are in increasing order from 1 to 12 in one clock or angular direction, the digits of said second series being in increasing order from 1 to 12 in the opposite clock or angular direction.

10. A dial as defined in claim 1, further comprising a fourth ring coaxial with the first three rings, said fourth ring bearing a plurality of alphanumeric markings, concerning auxiliary information for a user, said auxiliary information being selected from the group consisting of latitude, longitude and similar indications about current user location.

11. A dial as defined in claim 1, wherein the dial is mountable to an analog timepiece of the type having a movement with at least one first and one second drive shaft, wherein said first ring is adapted to be associated with first drive shaft and said second ring is adapted to be associated with said second drive shaft.

12. An analog dial timepiece, comprising a case housing a movement having at least one first and one second drive axis and a dial as defined in claim 1 associated with said movement, wherein said movement comprises means for automatic rotation of said first ring and said second ring.

13. A timepiece as defined in claim 12, wherein said movement comprises automatic means for manual or automatic rotation of one or more of the rings.

14. A timepiece as defined in claim 13, wherein said automatic means include a radio signal receiver adapted to receive information about the geographical position of the timepiece and transduce said information into angular rotation of at least said third ring.

15. A timepiece as defined in claim 14, wherein, said receiver comprises an electronic control unit, which is appropriately programmed for processing said radio signal selected from the group consisting of GPS and similar signals and generating a control to drive one or more of the drive shafts of said movement.

* * * * *